US006470500B1

(12) United States Patent
Sung

(10) Patent No.: US 6,470,500 B1
(45) Date of Patent: Oct. 29, 2002

(54) SWIMMING GOGGLES HAVING PADS WITH ANNULAR GROOVES AND SPONGES

(76) Inventor: Hsiu-Ying Sung, P.O. Box 26-757, Taipei (TW), 106

( * ) Notice: Subject to any disclaimer, the term of this patent is extended or adjusted under 35 U.S.C. 154(b) by 0 days.

(21) Appl. No.: 09/879,261

(22) Filed: Jun. 11, 2001

(51) Int. Cl.[7] ..... A61F 9/02
(52) U.S. Cl. ..... 2/428
(58) Field of Search ..... 2/428, 430, 426, 2/439, 445, 440, 452

(56) References Cited

U.S. PATENT DOCUMENTS 6,098,206 A * 8/2000 Chou ..... 2/428
6,289,523 B1 * 9/2000 Chiang ..... 2/428

* cited by examiner

*Primary Examiner*—Peter Nerbun
(74) *Attorney, Agent, or Firm*—Rosenberg, Klein & Lee

(57) ABSTRACT

The present invention proposes an improved pad structure comprising a frame, a pair of pads, and a pair of sponges. The frame comprises a pair of rims, a bridge, and a pair of fasteners. A ductile belt can be tied between the pair of fasteners. The pair of sponges are respectively joined with the pair of rims. The inner edges of the pair of pads respectively sheathe the pair of sponges. Although the positions of the sponges and the pads are interchanged, the swimming glasses also maintain resiliency. Moreover, when the swimming glasses are worn, because the pair of sponges are respectively sheathed at the inner edges of the pair of pads and the face contacts tightly with the pair of pads, penetration of water into the swimming glasses because of absorption of water by the sponges can be avoided.

1 Claim, 5 Drawing Sheets

SWIMMING GOGGLES HAVING PADS WITH ANNULAR GROOVES AND SPONGES

FIELD OF THE INVENTION

The present invention relates to an improved pad structure and, more particularly, to a pad structure of swimming glasses, wherein grooves are annularly formed at inner edges of a pair of pads, and a pair of sponges are sheathed in the grooves so that penetration of water into the swimming glasses due to absorption of water by the sponges can be avoided.

BACKGROUND OF THE INVENTION

As shown in FIGS. 1 and 2, a pair of swimming glasses in the prior art comprise a frame 10, a pair of pads 16, and a pair of sponges 17. The frame 10 comprises a pair of rims 11, a bridge 12, a pair of lenses 13, and a pair of fasteners 14. The bridge 12 is connected between the pair of rims 11. The pair of lenses 13 are respectively situated in the pair of rims 11. The pair of fasteners 14 are situated at two opposite outer sides of the pair of rims 11 with a ductile belt 15 tied between them. The pair of pads 16 are respectively joined at annular outer edges of the inner sides of the pair of rims 11. The pair of sponges 17 are respectively joined with the pair of pads 16. However, when the above swimming glasses are worn, water will penetrate into the swimming glasses because the pair of sponges 17 can absorb water.

Therefore, the above swimming glasses have inconvenience and drawbacks in practical use. The present invention aims to resolve the above problems in the prior art.

SUMMARY OF THE INVENTION

The primary object of the present invention is to provide an improved pad structure of swimming glasses, wherein positions of sponges and pads are interchanged to let the sponges be respectively joined with rims of the swimming glasses and grooves be annularly formed at inner edges of the pads to receive the sponges therein. When the swimming glasses are worn, the face will contact tightly with the pair of pads, hence maintaining resiliency and preventing penetration of water into the swimming glasses because of absorption of water by the sponges.

To achieve the above object, the present invention provides an improved pad structure comprising a frame, a pair of pads, and a pair of sponges. Grooves are annularly formed at inner edge of the pair of pads to receive the pair of sponges therein.

The various objects and advantages of the present invention will be more readily understood from the following detailed description when read in conjunction with the appended drawing, in which:

DETAILED DESCRIPTION OF THE PREFERRED EMBODIMENTS

Figure 1:
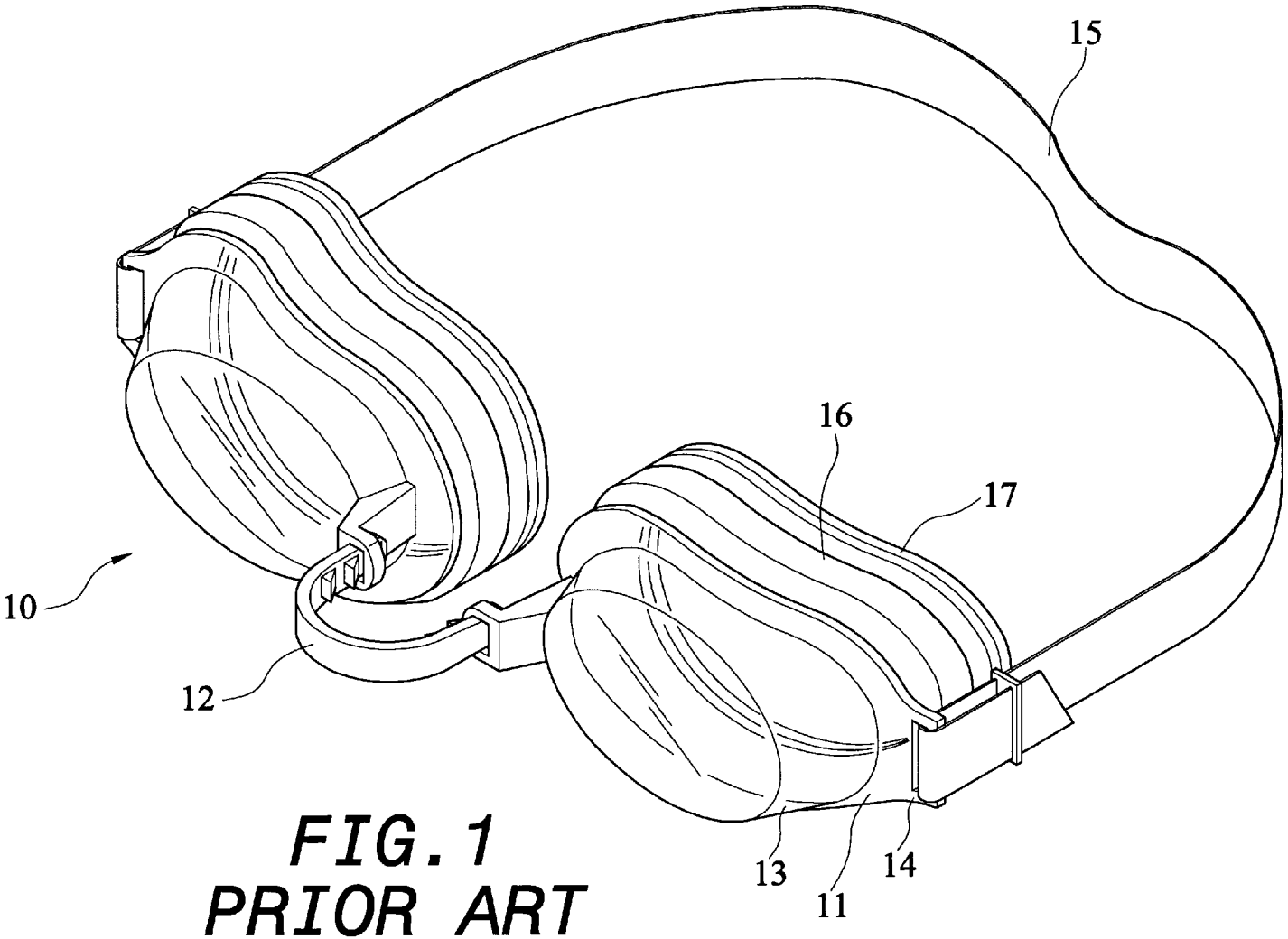
FIG. 1 PRIOR ART
FIG. 1 is a perspective view of a pair of swimming glasses in the prior art.
Figure 2:
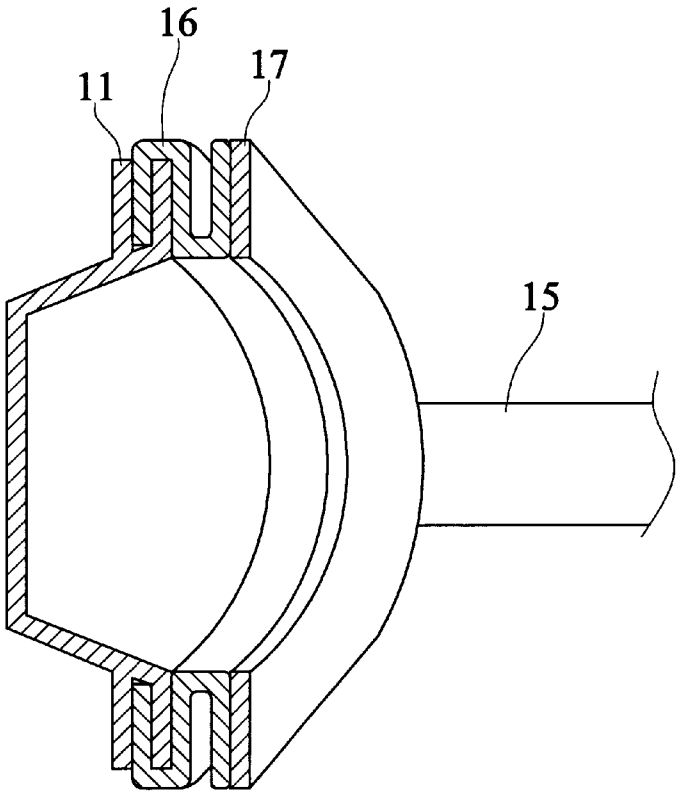
FIG. 2 PRIOR ART
FIG. 2 is a cross-sectional view of a pair of swimming glasses in the prior art.
Figure 3:
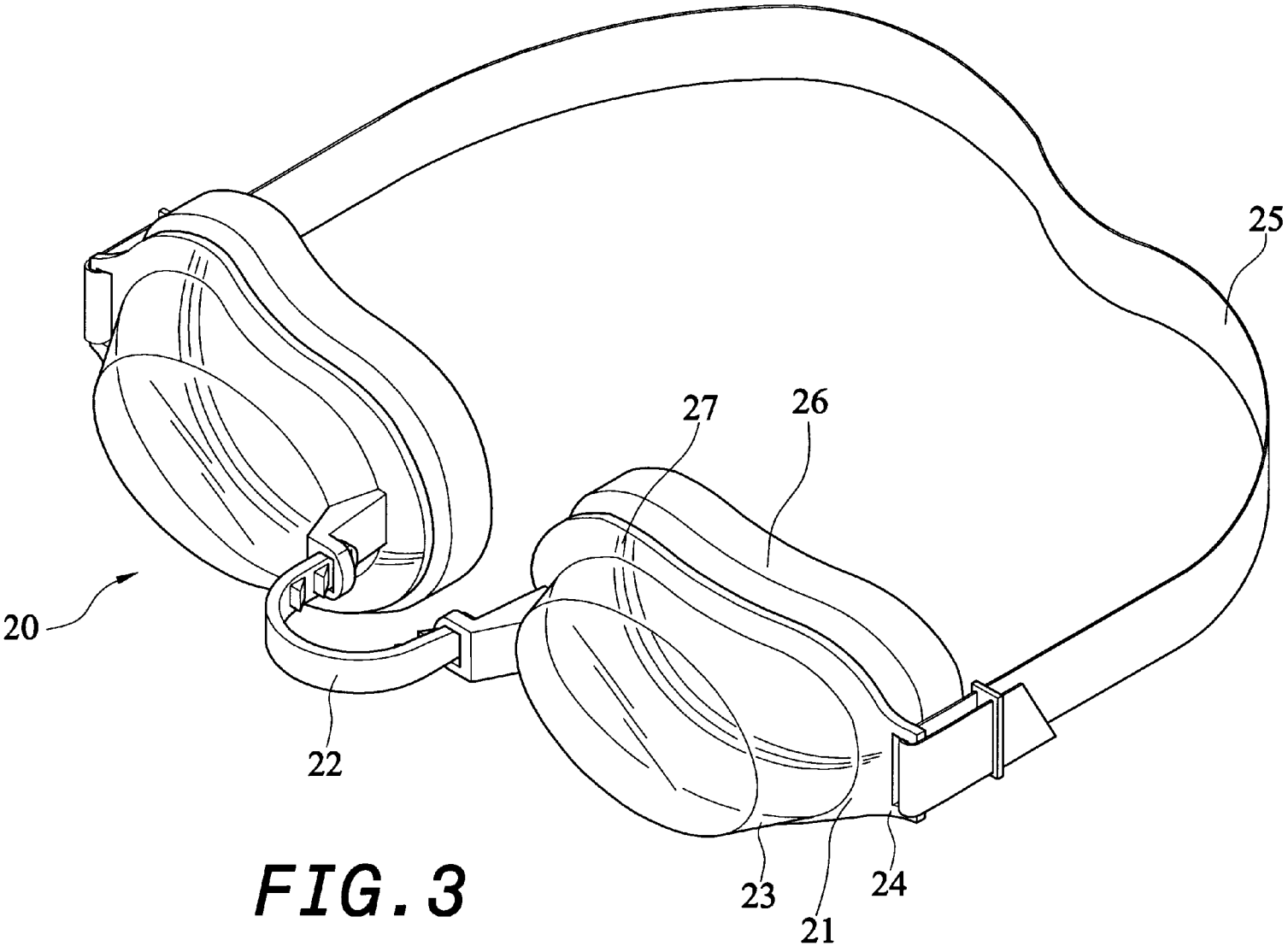
FIG. 3 is a perspective view of a pair of swimming glasses of the present invention.
Figure 4:
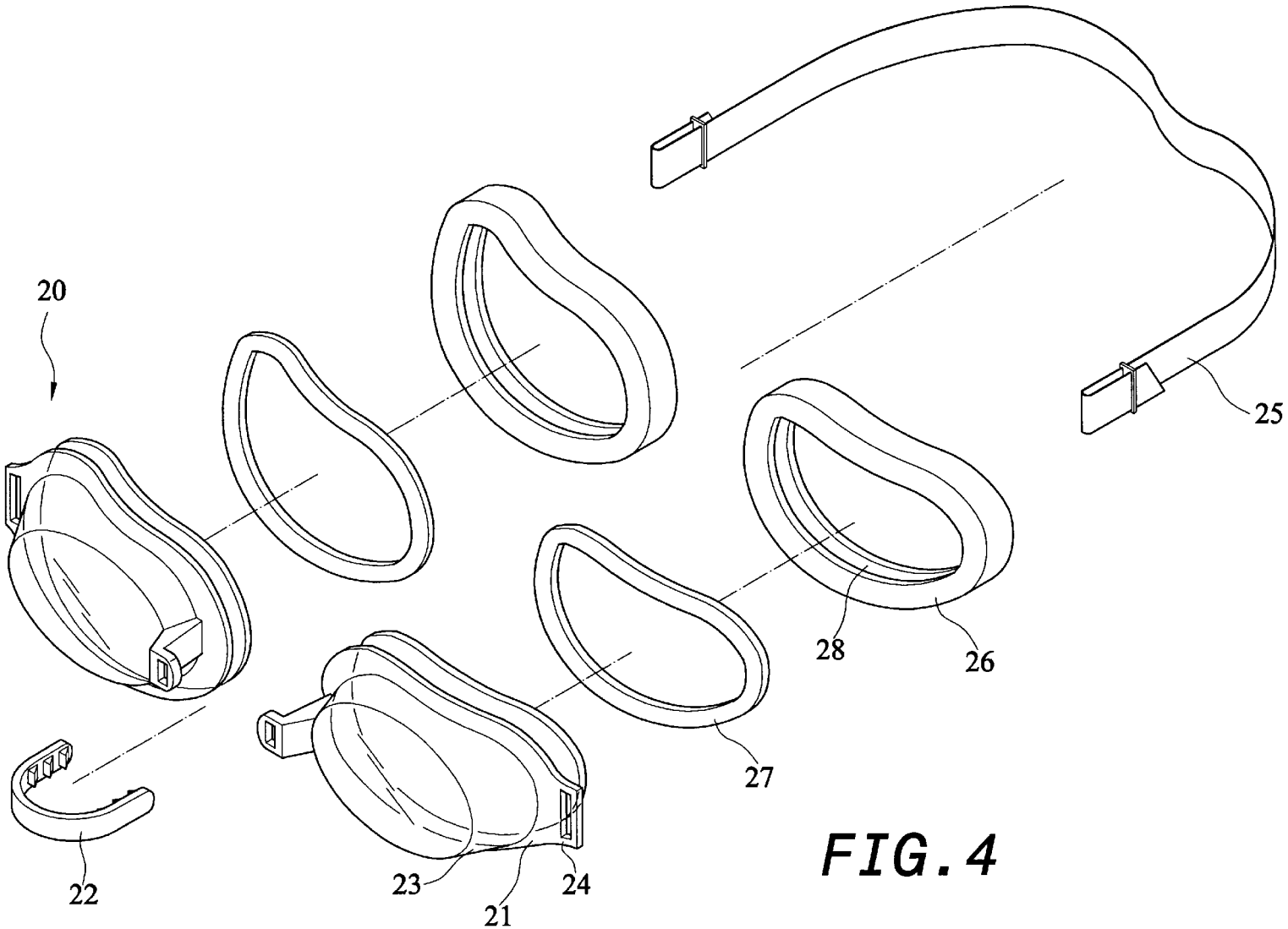
FIG. 4 is an exploded perspective view of a pair of swimming glasses of the present invention.
Figure 5:
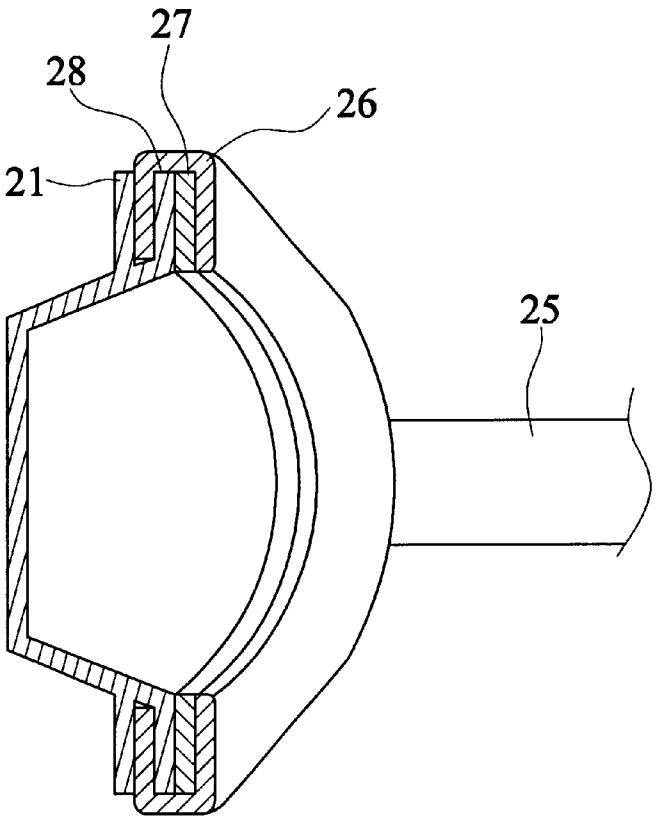
FIG. 5 is a cross-sectional view of a pair of swimming glasses of the present invention.

As shown in FIGS. 3 to 5, an improved pad structure of the present invention comprises a frame 20, a pair of pads 26, and a pair of sponges 27. The frame 20 comprises a pair of rims 21, a bridge 22, a pair of lenses 23, and a pair of fasteners 24. The bridge 22 is connected between the pair of rims 21. The pair of lenses 23 are respectively situated in the pair of rims 21. The pair of fasteners 24 are situated at two opposite outer sides of the pair of rims 21 with a ductile belt 25 tied between them. The pair of pads 26 are respectively joined at annular outer edges in the pair of rims 21. Grooves 28 are annularly formed at inner edges of the pair of pads 26 to receive the pair of sponges 27. Although the positions of the pair of sponges 27 and the pair of pads 26 are interchanged, the swimming glasses also maintain resiliency. When the swimming glasses are worn, the face will contact tightly with the pair of pads 26 to prevent penetration of water into the swimming glasses because of absorption of water by the pair of sponges 27.

The improved pad structure of the present invention has the following characteristics.

(1). Although the positions of sponges and pads are interchanged, the swimming glasses also maintain resiliency.

(2). Because the pair of sponges are respectively sheathed in the inner edges of the pair of pads, penetration of water into the swimming glasses because of absorption of water by the sponges can be avoided.

Although the present invention has been described with reference to the referred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. Swimming glasses having an improved pad structure, comprising:

a frame including (a) a pair of rims respectively holding a pair of lenses, each of said rims having opposing inner and outer end portions, (b) a bridge joining together said inner end portions of said pair of rims, and (c) a pair of fasteners respectively disposed on said outer end portions of said pair of rims;

a pair of pads respectively coupled to said pair of rims, each of said pads having opposing first and second sides and a central through opening extending therebetween, said first side of each of said pads being coupled to a rear side of a respective one of said rims and said second side of each of said pads being disposed in contact with a user's face, each of said pads having an annular groove formed in an edge thereof bordering said central through opening; and, a pair of sponges respectively disposed in said annular grooves of said pair of pads for maintaining resiliency of said pair of pads and preventing water infiltration into respective interior spaces of said rims.

* * * * *